US005323495A

United States Patent [19]

Han

[11] Patent Number: 5,323,495

[45] Date of Patent: Jun. 28, 1994

[54] DISCARDABLE TOILET PAD FOR USE IN WATER CLOSETS

[76] Inventor: Shao-Jie Han, No. 7, Beizhan Road, Sanyuanli, Guangdong Province, Guangzhou 510400, China

[21] Appl. No.: 2,655

[22] Filed: Jan. 11, 1993

[30] Foreign Application Priority Data

Jan. 11, 1992 [CN] China ..... 92 2 00138.3

[51] Int. Cl.[5] ..... A47K 13/18

[52] U.S. Cl. ..... 4/245.1; 4/245.4; 4/245.8; 4/245.9

[58] Field of Search ..... 4/245.1, 245.2, 245.3, 4/245.4, 245.5, 245.6, 245.7, 245.8, 245.9, 244.1, 244.2, 244.3

[56] References Cited

U.S. PATENT DOCUMENTS

| | | | |
|---|---|---|---|
| 597,264 | 1/1898 | Conradi, Jr. | 4/245.9 |
| 1,293,955 | 2/1919 | Sloan | 4/245.9 |
| 1,673,622 | 6/1928 | Engalitcheff | 4/245.9 |
| 3,851,341 | 12/1974 | Aoyama | 4/245.8 |
| 4,975,990 | 12/1990 | Chan | 4/245.9 |

FOREIGN PATENT DOCUMENTS

| | | | |
|---|---|---|---|
| 0349468 | 1/1990 | European Pat. Off. . | |
| WO88/01844 | 3/1988 | PCT Int'l Appl. . | |
| 5601 | of 1906 | United Kingdom | 4/245.9 |
| 388914 | 3/1933 | United Kingdom | 4/245.8 |
| 8604222 | 7/1986 | World Int. Prop. O. | 4/245.1 |

*Primary Examiner*—Henry J. Recla
*Assistant Examiner*—Charles R. Eloshway
*Attorney, Agent, or Firm*—Merchant, Gould, Smith, Edell, Welter & Schmidt

[57] ABSTRACT

A discardable toilet pad for use in water closets, comprising an upper sheet and a lower sheet. In use, the toilet pad is stuck onto a toilet seat by way of some adhesive substance coated on its lower side, and the lower sheet extends naturally downwards forming a curved strip into the bowl of a toilet. The toilet pad of the present invention is meant for avoiding splashing by excrement falling into the bowl, and preventing contagion caused through direct touch of the skin with a toilet seat, as well as avoiding cold stimulus to the body in cold weather. The toilet pad according to the present invention is easy to manufacture, low cost, and is convenient to carry.

9 Claims, 5 Drawing Sheets

DISCARDABLE TOILET PAD FOR USE IN WATER CLOSETS

BACKGROUND OF INVENTION

Flush toilets are at present very popular in use in common households and public places such as hotels, restaurants, etc.. However, they are unwholesome and may lead to spread of contagious diseases due to direct touch of the user's buttock skin with the toilet seat, and also splashing by excrements may occur since the user's buttocks usually go down much into the bowl when he sits on stool. Moreover, in winter season, cold stimulus would cause a very uncomfortable feeling when the user's skin is in touch with something cold and hard.

Inasmuch, toilet pads have been recently developed as daily sanitary articles. Nevertheless, all toilet pads in the prior art leave two problems unsolved:

1) Splashing by excrements; and

2) Proper fixing between the toilet pad and the toilet seat.

OBJECT OF INVENTION

The primary object of the present invention is to provide a new toilet pad, which can be stuck onto a toilet seat without slipping, to prevent contagious diseased due to direct touch of the buttock skin with a toilet seat. It is another object of the present invention to provide a special toilet pad comprising an upper sheet and a lower sheet linked to the former, said lower sheet extending naturally down into the bowl of a toilet and being provided with a cross of cut lines, so that excrements drop onto said lower sheet and further fall through said cross of cut lines provided therein down into the bowl of a toilet, and urine is obstructed by the same, to avoid any possible splashing by excrements from the bowl. A third object of the present invention is to provide a new toilet pad, which can wholly cover the seat of a toilet, so as to avoid any cold stimulus when a toilet is used in cold winter.

BRIEF DESCRIPTION OF DRAWINGS

The above-mentioned objects, as well as other advantages, of the present invention will become clear by the following detailed description of the invention and an embodiment, with reference to the accompanying drawings, wherein.

DESCRIPTION OF INVENTION

Figure 1A:
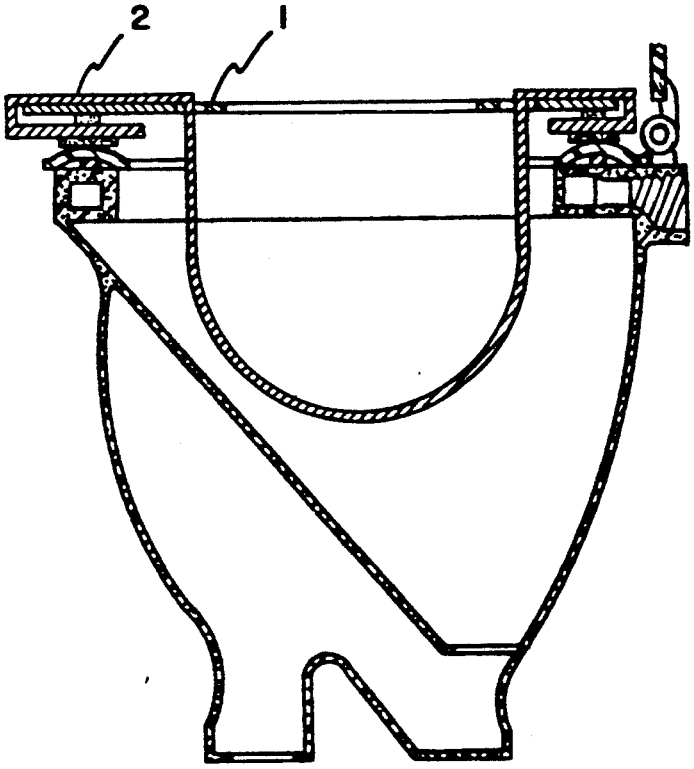
FIG. 1A is a front sectional view, taken generally along the line 1A—1A in FIG. 1B, showing one embodiment of a toilet pad in accordance with the present invention as it may be used on a toilet.
Figure 1B:
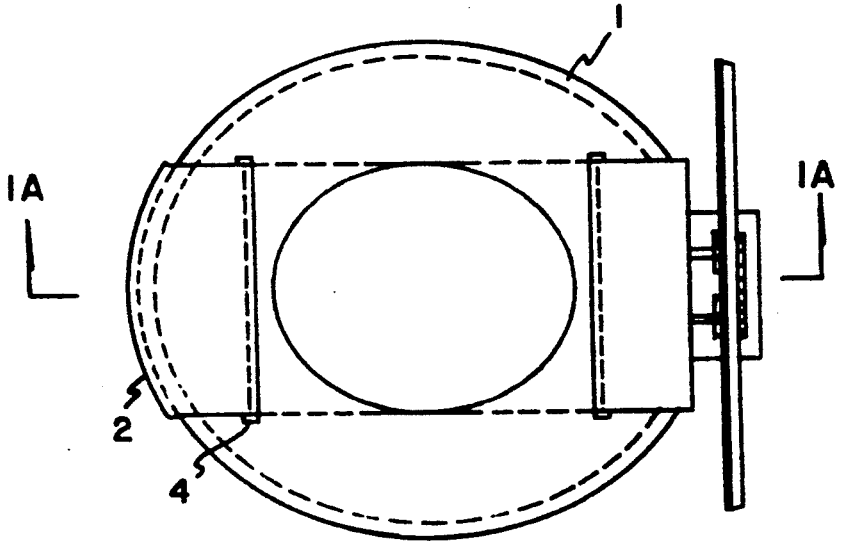
FIG. 1B is a top plan view of the embodiment shown in FIG. 1A.
Figure 2A:
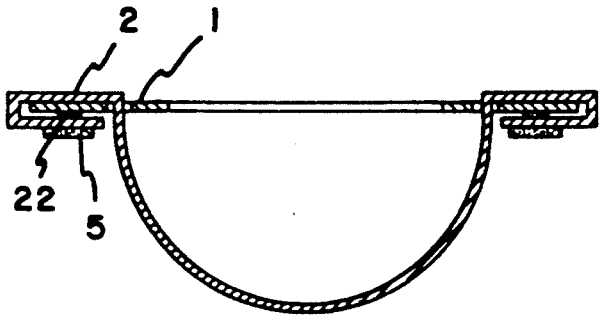
FIG. 2A is a front sectional view, taken generally along the line of 2A—2A in FIG. 2B, of the embodiment shown in FIG. 1A.
Figure 2B:
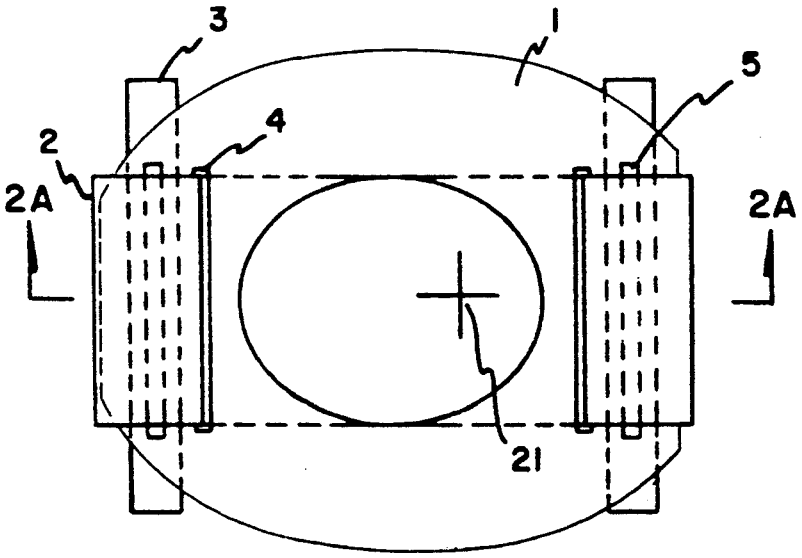
FIG. 2B is a top plan view of the embodiment shown in FIG. 2A.
Figure 3A:
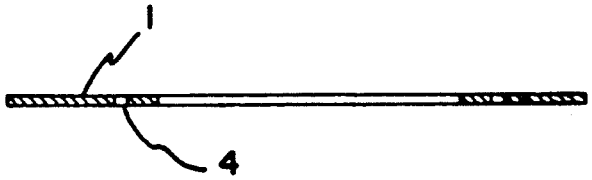
FIG. 3A is a cross-sectional view, taken generally along the line 3A—3A in FIG. 3B, of an upper sheet of the embodiment shown in FIG. 2A.
Figure 3B:
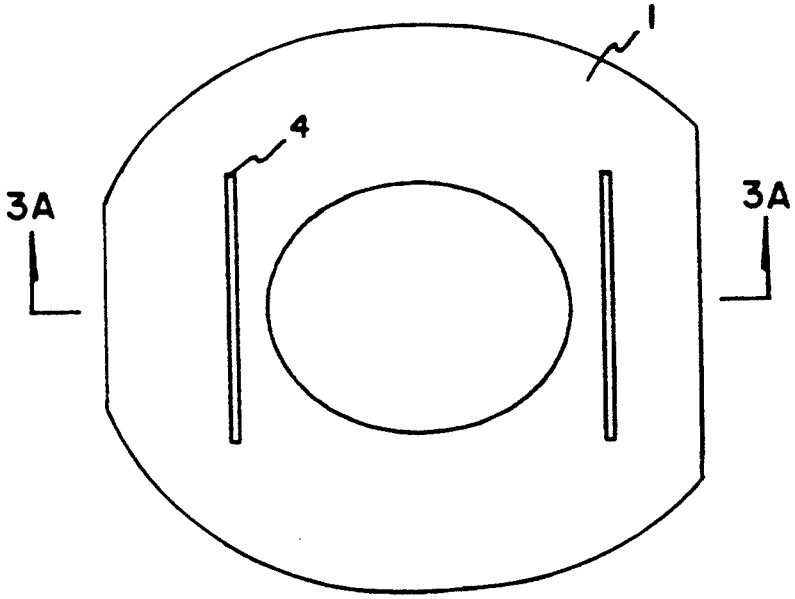
FIG. 3B is a top plan view of the upper sheet shown in FIG. 3A.

The toilet pad according to the present invention comprises an upper sheet and a lower sheet, said upper sheet being a bit larger in area than said seat and having an elliptical hole made in its middle, of which the major axis is a little smaller than that of the middle hole in said toilet seat; and said lower sheet being a stripe in shape and longer in size than the major axis of said elliptical hole in said upper sheet. The lower sheet is provided with a cross of cut lines in its rear portion, and is fixed at both ends to the corresponding edges of said upper sheet. The pad has some adhesive tapes stuck to its lower side and said tapes have protective covers, so that when said protective covers are torn off, the pad can be stuck onto a toilet seat.

In use, the toilet pad of the present invention is placed on top of a toilet seat, wholly covering the same, such that said lower sheet is in a proper direction fit for the bowl, and the upper sheet is stuck to the toilet seat so that the toilet pad as a whole will not slip. In this manner, direct touch of the user's buttock skin with the toilet seat is avoided, and excessive cold stimulus is also prevented.

When a toilet pad of the present invention is used, the excrements will just drop onto the lower sheet, and further fall through said cross of cut lines down into the bowl of the toilet, while the urine will be obstructed by said lower sheet, so that splashing of excrements and urine onto the user's buttocks is prevented, thus ensuring wholesome use of a toilet, particularly a public toilet. After use, the toilet pad can be flushed away together with the excrements.

The toilet pad according to the present invention is made with toilet paper or other water-dissoluble material(s).

The main advantage of the toilet pad according to the present invention lies in provision to users of a sanitary product, simple to manufacture at a low cost, and convenient to carry with. A toilet pad of the present invention, which can be stuck onto a toilet seat to prevent the pad from slipping, can not only effectively prevent spread of contagious diseases caused by sitting direct on a toilet seat and avoid splashing by excrements from the bowl of a toilet, but also reduce the strong cold stimulus when a toilet is used in cold winter.

Embodiment 1

In this embodiment, as will be clear from the description below, adhesive tapes are affixed not to said upper sheet, but to the end portions of said lower sheet.

Referring to FIGS. 1A to 4; the two ends of a lower sheet 2 are passed through two slots 4 provided in an upper sheet 1, and then folded back to form folded portions at the lower side of said upper sheet 1. Both sheets are then fixed together by some adhesive substance 22. Next, adhesive tapes 5 are affixed to the lower sides of said folded portions of said lower sheet 2, said tapes 5 being further covered by protective covers 3. In use, said protective covers 3 are torn off from said adhesive tapes 5, and the toilet pad is placed, such that said lower sheet 2 is properly lowered in the bowl of the toilet, and said adhesive tapes 5 are stuck to the toilet seat so that said seat is wholly covered. Thus, the toilet pad according to the present invention is ready for use.

The lower sheet 2 is provided with a cross of cut lines 21 in its rear portion, for excrements to fall through.

Both sheets of the present toilet pad are made of toilet tissue or other water-dissoluble material(s).

Toilet pads of the present invention are folded to a proper size and packed. They are, therefore, very convenient to carry with.

Embodiment 2

Figure 5:
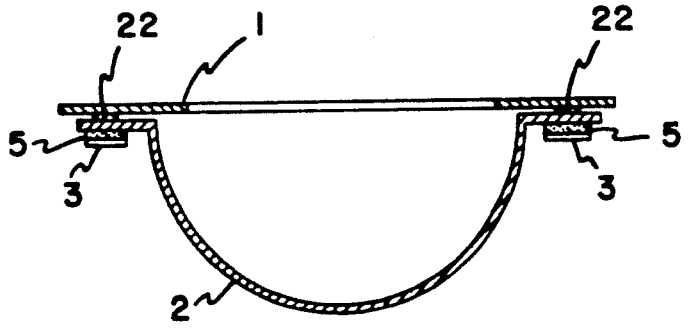
FIG. 5 is a front sectional view, showing assembly of a second embodiment of the present invention.

Same as Embodiment 1, with the only exception that the upper sheet 1 is not provided with slots 4, and that said lower sheet 2 is merely stuck at both ends to the lower side of said upper sheet 1 with a kind of adhesive substance 22. Referring to FIG. 5, in this embodiment, adhesive tapes 5 are stuck to the lower sides of both ends of said lower sheet 2 and are further covered by protective covers 3. The second Embodiment is simpler in the way how the upper sheet and lower sheet are fixed together.

What is claimed is:

1. A discardable toilet pad, comprising an upper sheet having first and second ends, a separate and distinct lower sheet having first and second ends, said lower sheet first end connected to a bottom surface of said upper sheet first end, said lower sheet second end connected to a bottom surface of said upper sheet second end, thereof an elliptical hole, which has a major axis that is smaller than that of the middle hole of the toilet seat; said lower sheet having a length longer than the major axis of the middle hole in said upper sheet and a width approximately equal to the minor axis of the middle hole of the toilet seat.

2. A toilet pad, as claimed in claim 1, wherein said upper sheet and lower sheet are both made of a substance selected from the group consisting of toilet tissue and water-dissolvable material.

3. A toilet pad, as claimed in claim 1, wherein said lower sheet is provided with a cross of cut lines in its rear portion.

4. A toilet pad as claimed in claim 1, wherein a slot is provided proximate each end of said upper sheet; a first end and a second end of said lower sheet pass through the slots proximate the first and second ends of said upper sheet, respectively, and are folded back around the corresponding ends of the upper sheet to form folded portions of said lower sheet; said folded portions of said lower sheet adhere to said upper sheet by a first adhesive means; and further, said folded portions each having a lower side with a second adhesive means disposed thereon for adhering to the toilet seat, said second adhesive means having a protective cover.

5. A toilet pad, as claimed in claim 4, wherein said upper sheet and lower sheet are both made of a substance selected from the group consisting of toilet tissue and water-dissolvable material.

6. A toilet pad, as claimed in claim 4, wherein said lower sheet is provided with a cross of cut lines in its rear portion.

7. A discardable toilet pad, comprising an upper sheet having first and second ends, a lower sheet linked to said upper sheet proximate the ends of the upper sheet, said pad having adhesive for keeping said pad from slipping on a toilet seat with a middle hole, said lower sheet extending downwards into the toilet forming a curved strip; said upper sheet being larger in area than said toilet seat and having in the middle thereof an elliptical hole, which has a major axis that is smaller than that of the middle hole of the toilet seat; said lower sheet having a length longer than the major axis of the middle hole in said upper sheet;

wherein a slot is provided proximate each end of said upper sheet; a first end and a second end of said lower sheet pass through the slots proximate the first and second ends of said upper sheet, respectively, and are folded back around the corresponding ends of the upper sheet to form folded portions of said lower sheet; said folded portions of said lower sheet adhere to said upper sheet by a first adhesive means; and further, said folded portions each having a lower side with a second adhesive means disposed thereon for adhering to the toilet seat, said second adhesive means having a protective cover.

8. A toilet pad, as claimed in claim 7, wherein said upper sheet and lower sheet are both made of a substance selected from the group consisting of toilet tissue and water-dissolvable material.

9. A toilet pad, as claimed in claim 7, wherein said lower sheet is provided with a cross of cut lines in its rear portion.

* * * * *

UNITED STATES PATENT AND TRADEMARK OFFICE

CERTIFICATE OF CORRECTION

PATENT NO. : 5,323,495
APPLICATION NO. : 08/002655
DATED : June 28, 1994
INVENTOR(S) : Han It is certified that error appears in the above-identified patent and that said Letters Patent is hereby corrected as shown below:

Col. 1, line 27 “diseased” should read --diseases--

Col. 1, line 28 “diseased” should read --diseases--

Figure 4:
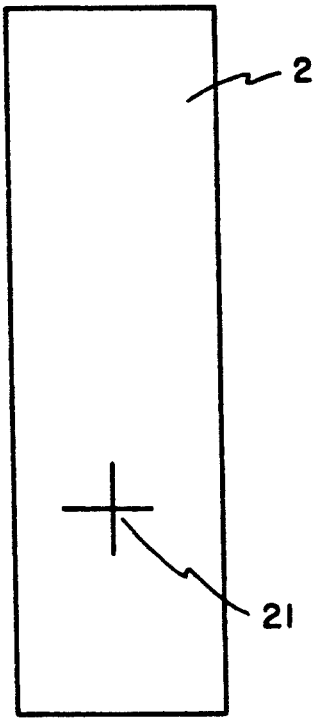

Col. 1, line 67 insert --Fig. 4 shows a lower sheet of said embodiment;-- after the word “3A;”

Col. 3, line 25 insert --said pad having an adhesive for keeping said pad from slipping on a toilet seat having a middle hole, said lower sheet extending downwards into the toilet forming a curved strip; said upper sheet being larger in area than said toilet seat and having in the middle-- after the word “end.”

Signed and Sealed this

Seventeenth Day of July, 2007

JON W. DUDAS
*Director of the United States Patent and Trademark Office*